US011793299B2

(12) United States Patent
Walker

(10) Patent No.: US 11,793,299 B2
(45) Date of Patent: Oct. 24, 2023

(54) SHED HAIR COLLECTION DEVICE

(71) Applicant: Makesha Walker, Clayton, NC (US)

(72) Inventor: Makesha Walker, Clayton, NC (US)

( * ) Notice: Subject to any disclaimer, the term of this patent is extended or adjusted under 35 U.S.C. 154(b) by 0 days.

(21) Appl. No.: 17/301,190

(22) Filed: Mar. 29, 2021

(65) Prior Publication Data

US 2022/0125189 A1 Apr. 28, 2022

Related U.S. Application Data

(60) Provisional application No. 63/104,551, filed on Oct. 23, 2020.

(51) Int. Cl.
*A46B 9/02* (2006.01)

(52) U.S. Cl.
CPC ..... *A46B 9/028* (2013.01); *A46B 2200/104* (2013.01)

(58) Field of Classification Search
None
See application file for complete search history.

(56) References Cited

U.S. PATENT DOCUMENTS 5,875,511 A * 3/1999 Nejdl ..... A46B 7/00 15/176.1
6,996,861 B1 * 2/2006 Clark, Jr. ..... A47K 7/04 4/606
8,631,523 B1 * 1/2014 Schneider ..... A47K 7/024 4/606
8,887,346 B1 * 11/2014 Madan ..... A47K 7/022 15/210.1
10,765,198 B2 9/2020 Watne et al.
2005/0084649 A1 * 4/2005 Patlakh ..... A61H 35/006 428/101
2007/0022527 A1 * 2/2007 Russo ..... A47K 7/026 4/606
2007/0089758 A1 * 4/2007 Koutscumbos ..... A47K 7/026 132/76.4
2019/0282038 A1 * 9/2019 Margulis ..... A47K 7/024
2020/0170397 A1 6/2020 Watne et al.
(Continued)

FOREIGN PATENT DOCUMENTS

CN 203106121 U 8/2013
CN 207969831 U 10/2018
CN 107848130 B 6/2020
(Continued)

*Primary Examiner* — Brian D Keller
*Assistant Examiner* — Dana Lee Poon
(74) *Attorney, Agent, or Firm* — Dunlap Bennett & Ludwig, PLLC; Anna L. Kinney

(57) ABSTRACT

A shed hair collection device includes a substantially planar mat and a gel pad. The mat has multiple substantially cylindrical protuberances with multiple nubs extending therefrom. A gel pad has multiple apertures attached to the mat such that each of the protuberances extends through one of the apertures. A shed hair collection device includes a hairbrush and a gel screen removably attached thereto. The hairbrush has a head with bristles and a handle. The gel screen has multiple apertures encircling the bristles. A shed hair collection device includes a silicone gel pad with multiple apertures and at least one loop formed at the perimeter. The silicone gel pad installs on a hairbrush head with bristles extending through the apertures.

7 Claims, 3 Drawing Sheets

(56) References Cited

U.S. PATENT DOCUMENTS

| | | | | |
|---|---|---|---|---|
| 2021/0315373 | A1* | 10/2021 | Awada | A46B 17/06 |
| 2022/0061518 | A1* | 3/2022 | Karras | A01K 13/002 |

FOREIGN PATENT DOCUMENTS

| | | | | |
|---|---|---|---|---|
| CN | 215542916 | U | * | 1/2022 |
| CN | 216061695 | U | * | 3/2022 |
| ES | 2302718 | T3 | | 8/2008 |

* cited by examiner

SHED HAIR COLLECTION DEVICE

CROSS-REFERENCE TO RELATED APPLICATION

This application claims the benefit of priority of U.S. provisional application No. 63/104,551, filed Oct. 23, 2020, the contents of which are herein incorporated by reference.

BACKGROUND OF THE INVENTION

The present invention relates to collection of shed strands of hair and, more particularly, to device therefor.

Everyone wants to look good. Women and men are both conscious about their appearance. Looking attractive is a basic desire of human beings. Many inventions have been made to entertain this instinct. Hair is often the most important aspect of anyone's appearance, reflecting the individual's personality. People concern themselves with hair care for daily styling, for weddings or family events, and for interviews.

Shed hairs get trapped and tangled in one's fingers during the hair washing and manipulation process. Currently available products intended to collect shed hairs are too complex and cumbersome.

Many inventions have been made in the hair cutting or trimming arts. However, few prior art references teach products that facilitate hair collection methods. For instance, a Spanish patent 2,302,718T3 is drawn to a hair cutting device with an internal vacuum. Another patent to a hair container and kit for a hair cutting appliance bears Chinese patent 1,078,48130B. A hair collecting enclosing cloth for haircut is taught by Chinese patent 2,031,06121U. Chinese patent 2,079,69831 U is drawn to a kind of haircut collector.

As can be seen, there is a need for a simple device effective to remove loose hair strands from a user's hands.

SUMMARY OF THE INVENTION

The present invention provides a simple collection device for removing shed hairs from fingers and hands, comprising a mat with a hair remover gel pad. In another embodiment, the collection device removes shed hairs from a hairbrush, comprising a hair remover gel pad with one or more handles.

The hair collection device may have any combination of advantages selected from the group consisting of: simple to use, durable, efficient, easily cleanable, washable, bio-degradable, dishwasher safe and retains its size and shape even after multiple uses. Additionally, the beauty of the hair removing mat is that it comes as a system that will make life a lot easier and hassle free. The hair remover mat is also perfect for use after a shower.

In one aspect of the present invention, a shed hair collection device is provided, comprising a substantially planar mat having a plurality of substantially cylindrical protuberances with a plurality of nubs extending therefrom and a gel pad having a plurality of apertures attached to the substantially planar mat, such that each of the plurality of substantially cylindrical protuberances extends through one of the plurality of apertures.

In another aspect of the present invention, a shed hair collection device is provided, comprising a hairbrush comprising a head with bristles extending therefrom and a handle; and a gel screen removably attached thereto having a plurality of apertures encircling the bristles.

In another aspect of the present invention, a shed hair collection device is provided, comprising a silicone gel pad with a plurality of apertures and at least one loop formed at a perimeter thereof, said silicone gel pad being operative to install on a hairbrush head with bristles extending through the plurality of apertures.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a hair collection device comprising a mat base and a gel pad. In another embodiment, the hair collection device comprises a gel pad with apertures for removable installation on a hairbrush.

The substantially planar mat base comprises bristles or protuberances extending therefrom, similar to brush bristles. The bristles may be any suitable size, such as about 1 inch in height. The bristle type may vary. In some embodiments, the bristles further comprise fingers or nubs protruding from the bristles.

The gel pad sits in between the bristles of the brush pad. Loops on the gel pad secure it to the mat base. The gel pad may have a handle or grasping tab to pull the pad up.

In some embodiments, the hair collection device further comprises attachment components selected from the group consisting of: suction cups, hook, buttons, loops, and combinations thereof. For example, a hook and suction cups on the bottom of the mat base may be used to hang the mat in the shower and/or on a wall and may also be used on a table or other flat surface. Buttons may be provided on the mat base to secure the gel pad loops.

A method of using the inventive hair collection device may include the following. While washing or styling hair, as shed hairs get trapped on hands, the user may rub a hand across the bristles to remove loose strands of hair from the user's skin. To clean the shed hairs from the bristles, the user may lift the gel pad by the handle.

The materials of manufacture are not particularly limited. The mat base may be an elastic plastic material. The mat, bristles, and gel pad may be silicone-based, for example. The particular shape or configuration of the mat and the gel pad is not particularly limited.

The method of manufacture is not particularly limited. For example, the mat and/or the gel pad may be manufactured using injection molding.

Figure 1:
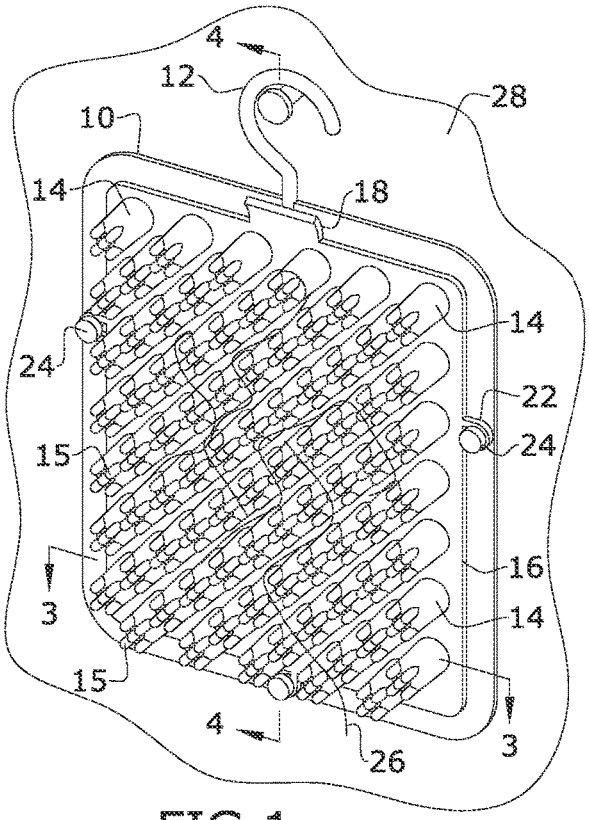
FIG. 1 is a perspective view of a shed hair collection device according to an embodiment of the present invention, shown in a storage position.
Figure 2:
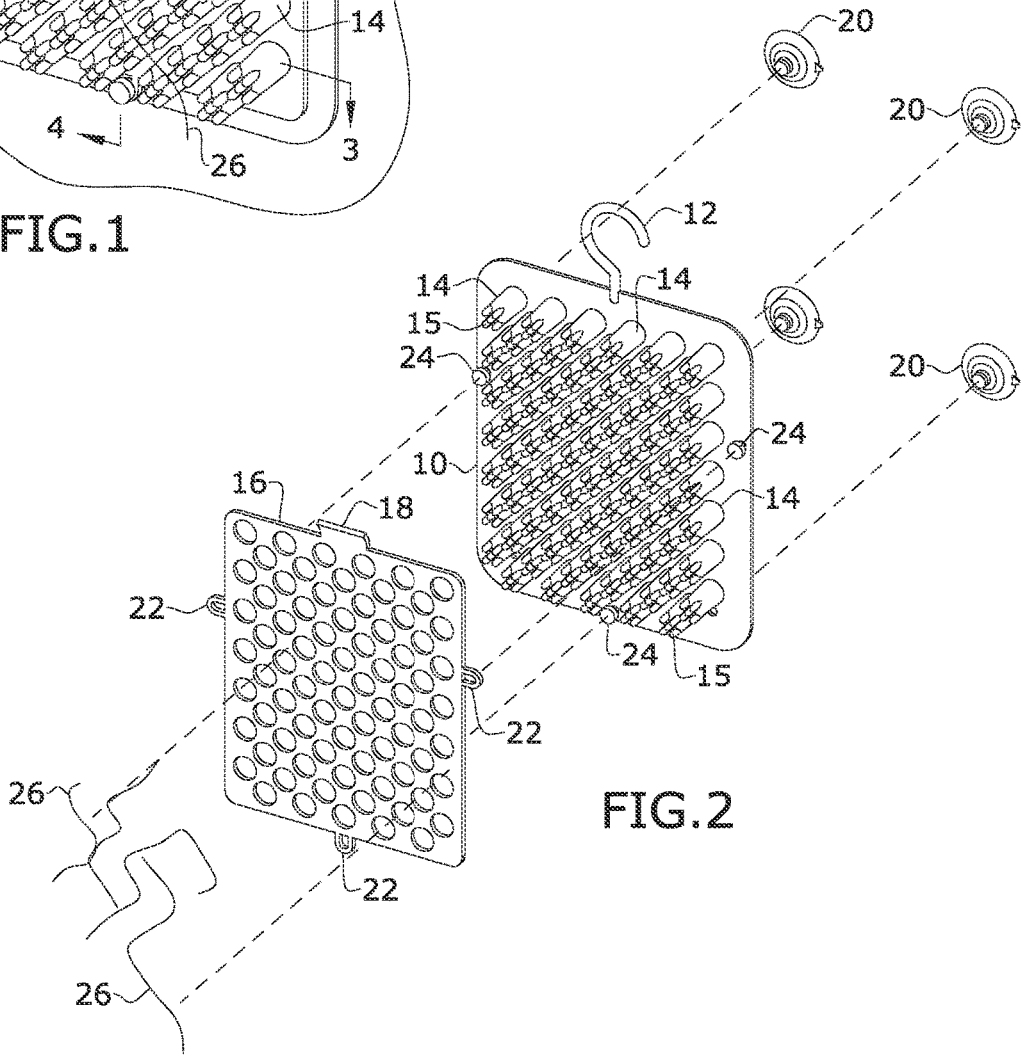
FIG. 2 is an exploded view thereof.
Figure 3:
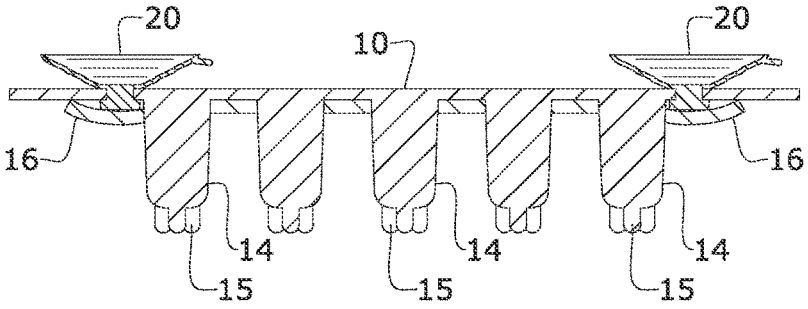
FIG. 3 is a sectional view thereof, taken along line 3-3 of FIG. 1.
Figure 5:
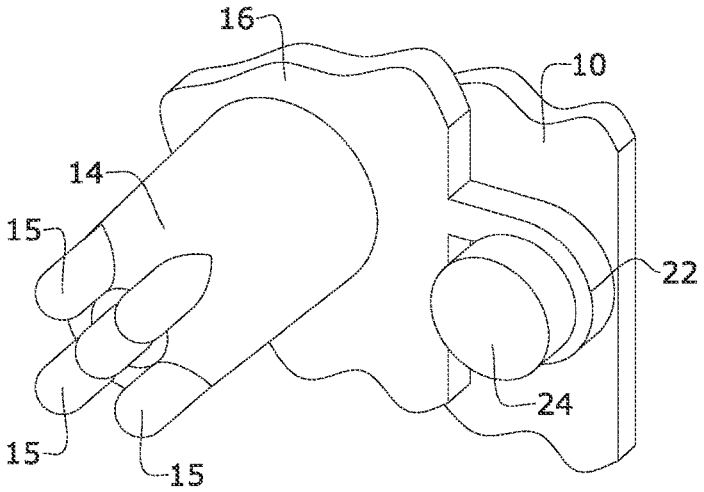
FIG. 5 is an enlarged detail view thereof.
Figure 4:
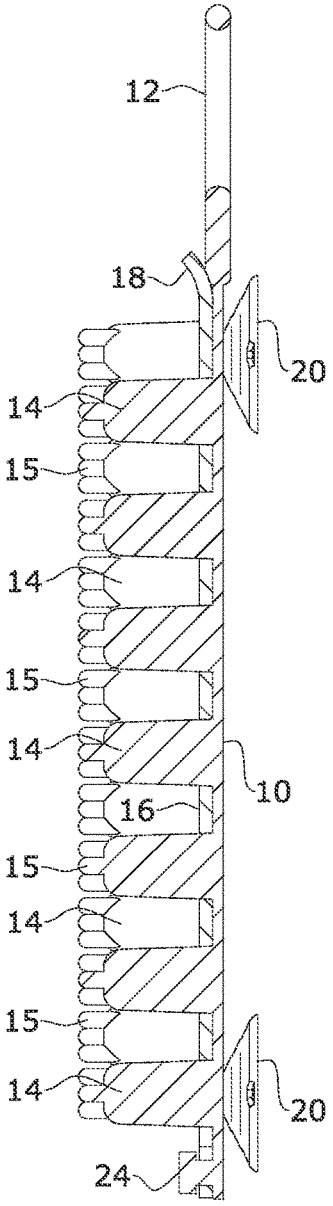
FIG. 4 is a sectional view thereof, taken along line 4-4 of FIG. 1.
Figure 6:
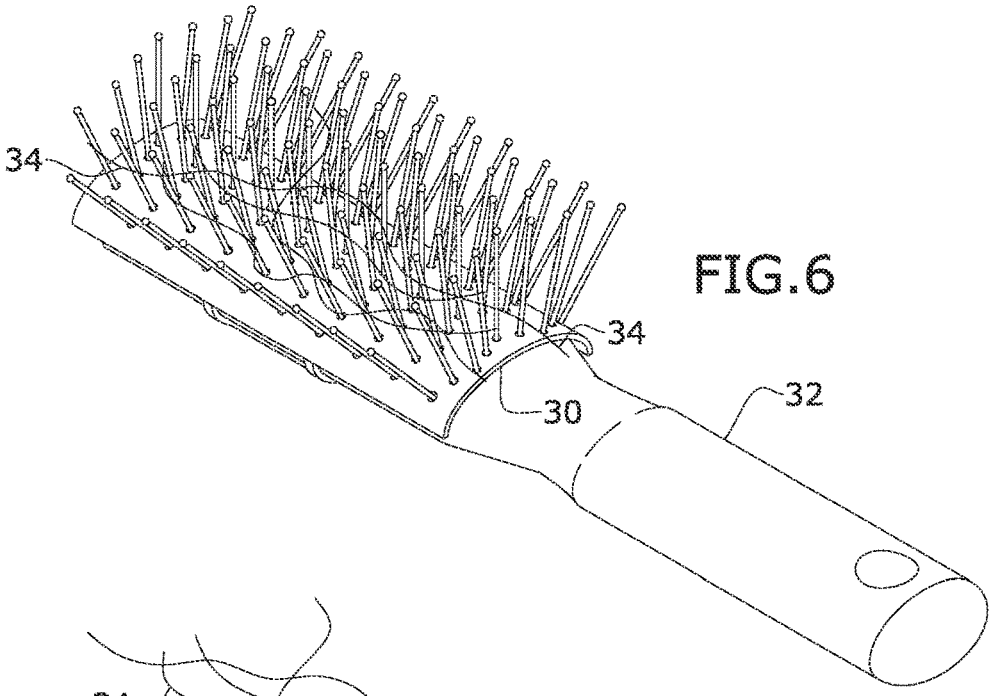
FIG. 6 is a shed hair collection device according to another embodiment of the present invention.
Figure 7:
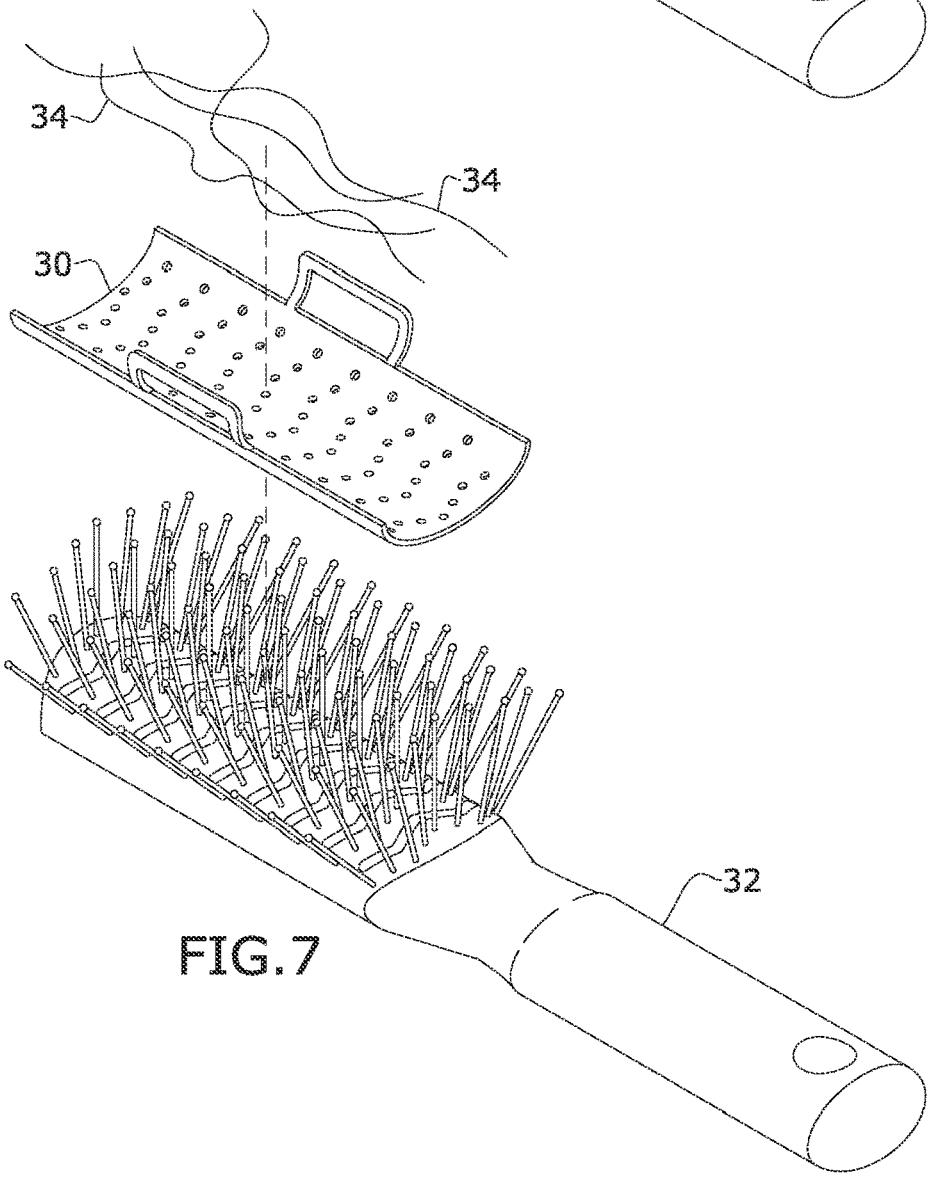
FIG. 7 is an exploded view thereof.

Referring to FIGS. 1 to 7, a shed hair collection device is shown comprising a mat having a base 10 with bristles 14 extending therefrom and a silicone gel pad 16 with a handle 18 and a plurality of apertures that surround the bristles 14 at the base 10. The bristles 14 are substantially cylindrical or rounded conical in shape. Nubs or fingers 15 protrude from the end of the bristles 14. The gel pad 16 is removably attached with loops 22 operative to couple to base buttons or knobs 24 extending from the perimeter adjacent to the edges of the mat base 10. FIG. 1 shows the device holding shed hair 26 attached to a shower wall 28 with a mat hook 12 extending from an edge of the base 10 and with suction cups 20 on a surface opposite the bristles 14, as shown in FIGS. 2-4. FIGS. 6 and 7 show another embodiment of the present invention comprising a silicone gel screen 30 with a plurality of apertures which may be removably attached to a hairbrush 32 having a head with bristles to collect shed hair 34.

It should be understood, of course, that the foregoing relates to exemplary embodiments of the invention and that modifications may be made without departing from the spirit and scope of the invention as set forth in the following claims.

What is claimed is:

1. A shed hair collection device, comprising:

a) a unitary mat having a plurality of round protuberances extending perpendicularly from a substantially planar surface, each round protuberance having a plurality of parallel projections extending directly axially therefrom; and b) an elastic polymer pad having a plurality of apertures mounted to the unitary mat such that each of the plurality of rounded protuberances extends through one of the plurality of apertures;

wherein the unitary mat and the plurality of round protuberances define a monolithic structure.

2. The shed hair collection device of claim 1, wherein the plurality of round protuberances and the at least one projection are effective to remove shed strands of hair from skin.

3. The shed hair collection device of claim 1, wherein the unitary mat further comprises a plurality of suction cups on a surface opposite the plurality of round protuberances.

4. The shed hair collection device of claim 1, wherein the unitary mat further comprises a hook extending from an edge thereof.

5. The shed hair collection device of claim 1, wherein the elastic polymer pad further comprises a grasping tab.

6. The shed hair collection device of claim 1, wherein the unitary mat further comprises a plurality of knobs adjacent to edges thereof.

7. The shed hair collection device of claim 6, wherein the elastic polymer pad further comprises a plurality of loops operative to couple to the plurality of knobs.

* * * * *